US007100555B2

(12) United States Patent
Imaizumi et al.

(10) Patent No.: US 7,100,555 B2
(45) Date of Patent: Sep. 5, 2006

(54) VALVE TIMING CONTROLLER

(75) Inventors: Tatsuhiko Imaizumi, Kariya (JP); Tomonari Chiba, Nishikamo-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/261,587

(22) Filed: Oct. 31, 2005

(65) Prior Publication Data

US 2006/0090719 A1 May 4, 2006

(30) Foreign Application Priority Data

Oct. 29, 2004 (JP) ..... 2004-315581

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,647,936 B1 * 11/2003 Lewis ..... 123/90.17

FOREIGN PATENT DOCUMENTS

JP 2002-89212 3/2002

* cited by examiner

*Primary Examiner*—Thomas Denion
*Assistant Examiner*—Ching Chang
(74) *Attorney, Agent, or Firm*—Nixon & Vanderhye P.C.

(57) ABSTRACT

An outer bottom of an engaging member, which is formed as a tubular shape having a bottom, is contact with an inner wall of a housing existing in the opposite direction of a fitting direction. The engaging member urges and covers one edge of an urging member. As a result, pressure, which the inner wall of the housing receives, can be decreased comparing with the structure, in which the urging member is directly in contact with the inner wall of the housing.

6 Claims, 4 Drawing Sheets

VALVE TIMING CONTROLLER

CROSS-REFERENCE TO RELATED APPLICATION

This application is based on Japanese Patent Application No. 2004-315581 filed on Oct. 29, 2004, disclosure of which is incorporated herein by reference.

FIELD OF THE INVENTION

The present invention relates to a valve timing controller for varying an operation timing of at least one of an intake valve and an exhaust valve in an internal combustion engine.

BACKGROUND OF THE INVENTION

A valve timing controller is known in the related art, in which a rotor rotating with one of a crankshaft and a camshaft is housed in a housing rotating with the other, and the housing is divided into a retard chamber and an advance chamber by a vane formed at the rotor. Rotation phase of the camshaft for the housing is adjusted by controlling oil pressure in the retard chamber and the advance chamber.

The camshaft receives fluctuation torque in the direction of retard or advance when an intake valve or an exhaust valve is operated. When the camshaft receives the fluctuation torque in condition that the oil pressure is not enough high like an engine start timing, the rotor rotating with the camshaft flip-flops relative to the housing, and the vane conflicts with the housing, so that slapping sound can arise.

In the related art, the rotation phase of the camshaft for the housing is bound by making a rock pin housed in the rotor fit to a fitting hole formed at the housing by a spring, when the rotor exists in the predetermined position, so that the slapping sound can be restrained.

However, in the structure of the related art, when edge of the spring repeatedly slides for an inner wall of the housing, the wall of the housing wears, so that oil can leak between the retard chamber and the advanced chamber. To restrain the wear of the housing, JP-2002-89212A discloses that the inner wall of the housing avoids directly contacting with the edge of the spring by engaging the edge of the spring with a spring supporting member.

However, in the prior art, the edge of the spring is engaged to a flange, in which a stopper protrusion to stop the rock pin is formed in the rock pin side of the flange and a spacer protrusion is formed in the opposite side of the rock pin for the flange, so that shape of the spring supporting member can become complicated.

SUMMARY OF THE INVENTION

The present invention is made in view of the above matters, and it is an object of the present invention to provide a valve timing controller to be easily manufactured and be able to restrain the wear of the housing.

According to an aspect of the present invention, an outer bottom of an engaging member, which is formed as a tubular shape having a bottom, is contact with an inner wall of a housing existing in the opposite direction of a fitting direction. The engaging member covers one edge of the urging member. As a result, pressure, which the inner wall of the housing receives, can be decreased comparing with the structure, in which the urging member directly touches with the inner wall of the housing, because touch area, in which outer bottom of the engaging member is contact with the inner wall of the housing, is large. Therefore, the wear of the inner wall of the housing can be restrained, so that the working oil leakage by the wear can be restrained.

Furthermore, the engaging member comprises simple structure as tubular shape having the bottom, so that it can be easily produced.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF PREFERRED EMBODIMENTS

Embodiments of the present invention will be described hereinafter with reference to the drawings.

A valve timing controller 10 of the present embodiment controls operation timing of an exhaust valve by oil pressure.

Figure 1:
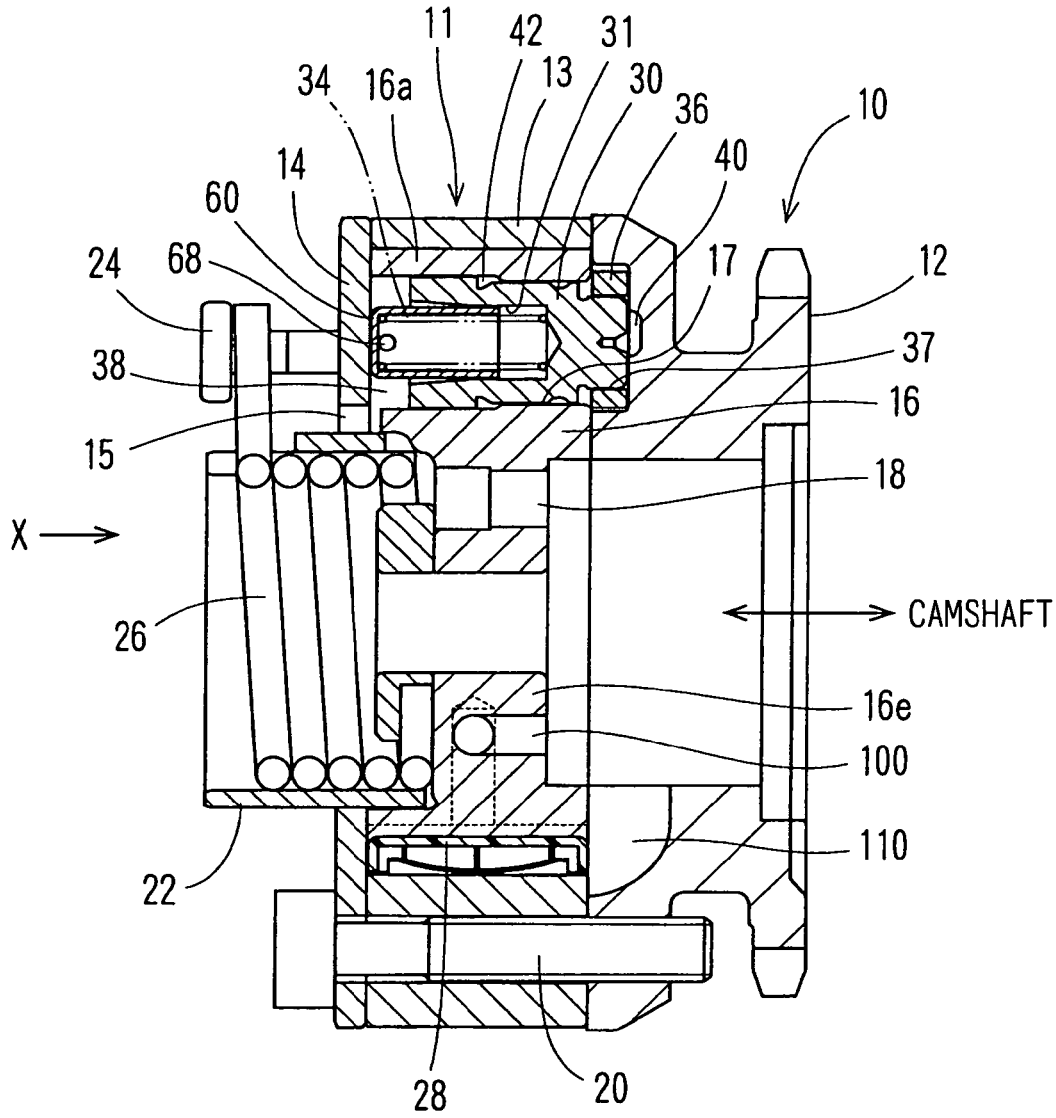
FIG. 1 is a cross-section view showing a valve timing controller according to an embodiment of the present invention.

As disclosed in FIG. 1, a housing 11 comprises a chain sprocket 12, a shoe housing 13 and a front plate 14, which are fixed by a bolt 20 coaxially, and houses a vane rotor 16 rotatably. Each of the chain sprocket 12, the shoe housing 13 and the front plate 14 is made of iron and formed by casting or sintering and so on. The chain sprocket 12 is connected with a crankshaft by a chain (not shown). Driving force from the crankshaft is transmitted to the chain sprocket 12, so that the chain sprocket 12 rotates synchronizing with the crankshaft. The vane rotor 16 is fixed with the camshaft by a bolt (not shown) through a bush 22 and rotates with the camshaft. The camshaft operates opening and closing of the exhaust valve. The housing 11, the vane rotor 16 and the camshaft rotate clockwise seeing from the X direction. This rotative direction is considered as an advance direction hereinafter.

Figure 2:
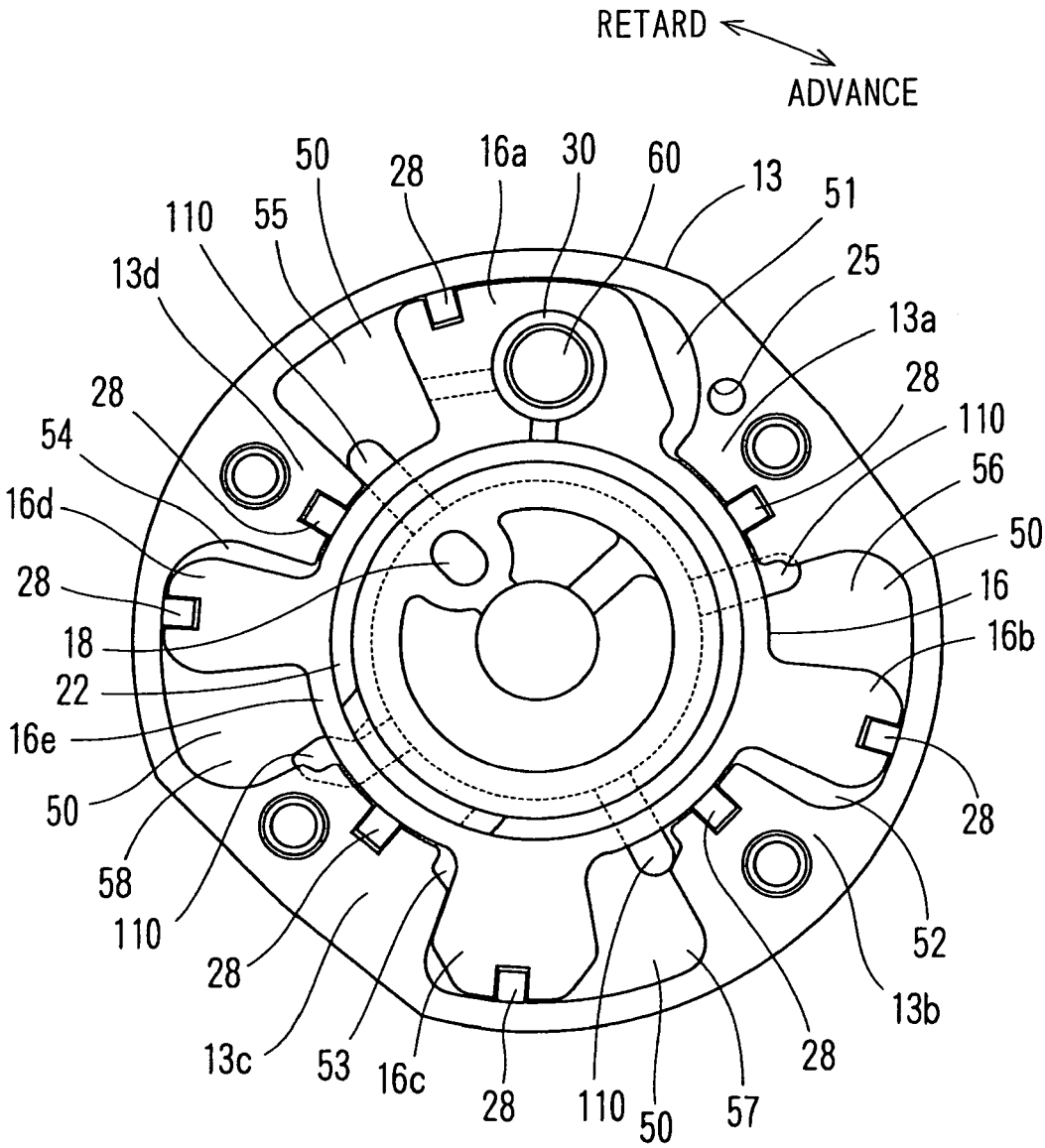
FIG. 2 is a schematic view showing the valve timing controller seen from the direction of an arrow X of FIG. 1.

The chain sprocket 12 comprises one side wall of the housing 11. The front plate 14 comprises the other side wall of the housing 11. As shown in FIG. 2, the shoe housing 13 is formed circularly and has four shoes 13*a*, 13*b*, 13*c*, 13*d*, which are projected on the inside of the shoe housing 13 at regular interval in the circumferential direction. A fan shape space 50 is formed between the shoes.

The vane rotor 16 is made of iron and is formed by casting or sintering and so on. The vane rotor 16 has a boss 16*e* contacting with an end face of the camshaft in the direction of rotation axis, and has four vanes 16*a*, 16*b*, 16*c*, 16*d*, which are projected on the outside from the boss 16*e* at regular interval in the circumferential direction. A positioning pin (not shown) is inserted into a pin hole 18 formed at boss 16*e* and a pin hole formed at the camshaft in order to define positions of the vane rotor 16 and the camshaft in the rotative direction.

Each vane is rotatably housed in the space 50 and divides the space 50 into a retard oil pressure chamber and an advance oil pressure chamber. The camshaft, the vane rotor 16 and the bush 22 are coaxially rotatable for the housing 11.

A spring pin 24 is press-fitted into a press-in hole 25 formed at the shoe 13*a*. One end of a spring 26 formed inside the bush 22 is fixed to the spring pin 24 and the other end is fixed to the bush 22. The spring 26 works as torque to rotate the vane rotor 16 in the advance direction for the housing 11.

Fluctuating torque received from the exhaust valve fluctuates in the both positive and negative direction when the camshaft drives the exhaust valve. The positive direction means the advance direction and the negative direction means the retard direction. Average of the fluctuating torque works in the positive (retard) direction. Torque in the advance direction applied from the spring 26 to the vane rotor 16 is the same torque as the average of the fluctuating torque which the camshaft receives.

A seal member 28 is made of resin and is inserted into an inner wall of the each shoe and an outer wall of the each vane, as shown in FIG. 2. There is small clearance between each shoe and an outer wall of the boss 16*e* and between the outer wall of each vane and the inner wall of the shoe housing 13. The seal member 28 prevents oil leakage to the oil chamber through the clearance. The seal member 28 is pushed to the outer wall of the boss 16*e* and the inner wall of the shoe housing 13 by each spring (not shown).

Figure 3:
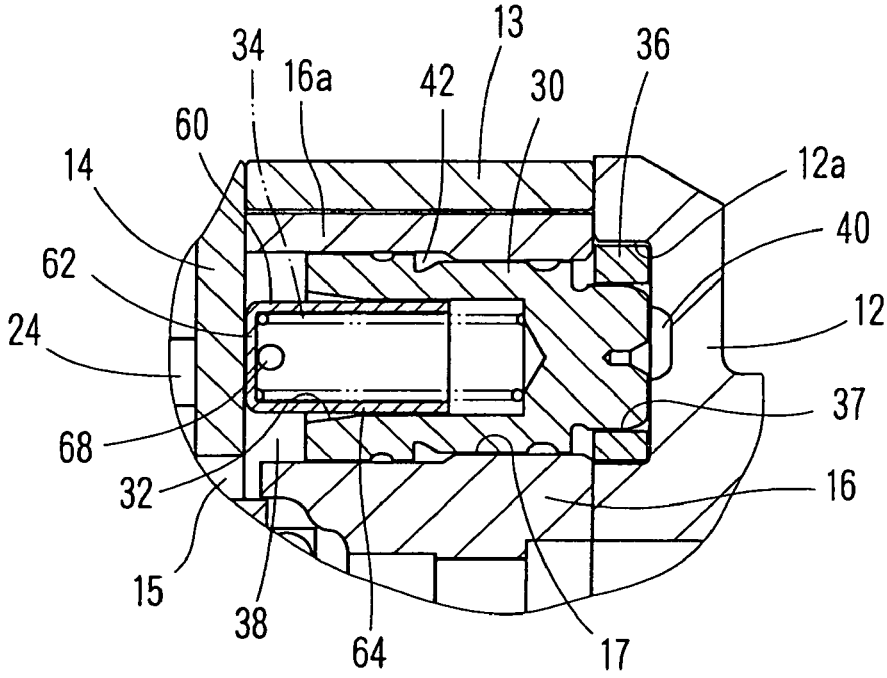
FIG. 3 is a cross-section view showing the condition that a stopper piston is fitted to a fitting ring.
Figure 4:
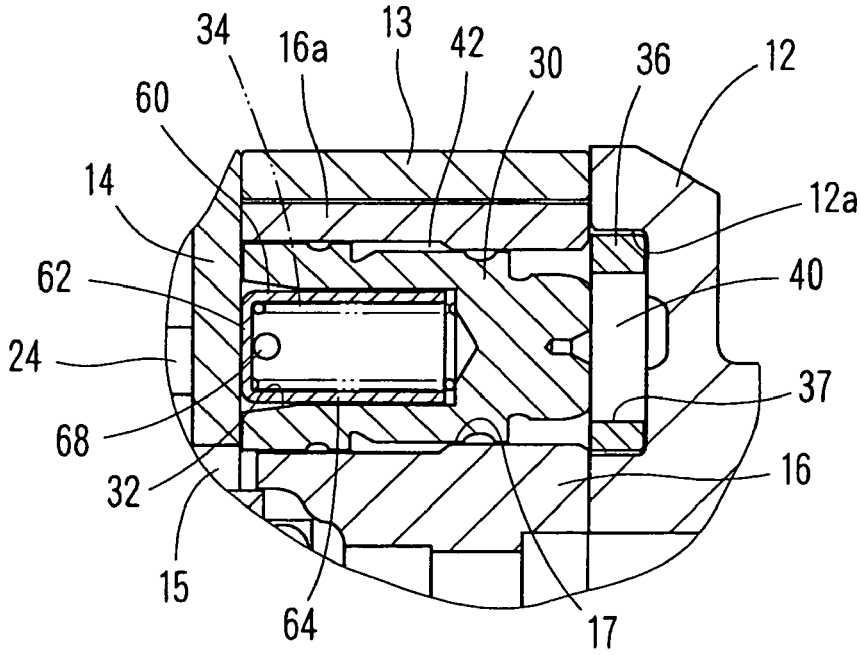
FIG. 4 is a cross-section view showing the condition that the stopper piston pulls out of the fitting ring.

A stopper piston 30 is formed as a tubular fitting member having a bottom portion. The stopper piston 30 is reciprocately housed in a penetrated hole 17 formed in the direction of the rotation axis. As shown in FIGS. 3 and 4, opening side of a hole 31 is formed as a taper hole 32, which is tapered toward the back of the hole 31. One side of a spring 34 is engaged with an inside bottom of a cup 60 and the other side is engaged with a bottom of the hole 31. The spring 34 urges the stopper piston 30 toward a fitting ring 36. The fitting ring 36 is press-fitted into a press fitting hole 12*a* of the chain sprocket 12. The fitting ring 36 has a fitting hole 37, which fits a bottom of the stopper piston 30.

When the stopper piston 30 is fitted into the fitting ring 36, relative rotation of the vane rotor 16 for housing 11 is bound and the angular position is suitable for an engine start. That is the most advanced position of the valve timing control device for the exhaust valve 10. A back-pressure chamber 38 arranged at the opposite side of the fitting ring 36 for the stopper piston 30 communicates with a communicating hole 15 formed at the front plate 14 in the advanced position, and communicates with air. The stopper piston 30 can reciprocated at the most advanced position.

A first pressure chamber 40 formed at the side of the fitting ring 36 communicates with the retard oil pressure chamber 51. A second pressure chamber 42 formed around the stopper piston 30 communicates with an advance oil pressure chamber 55. Pressure of the first pressure chamber 40 and the second pressure chamber 42 works in the direction in which the stopper piston 30 exits from the fitting ring 36. The first pressure chamber 40 and the second pressure chamber 42 comprise a releasing chamber. The communicating hole 17, the stopper piston 30, the spring 34, the fitting hole 37, the first pressure chamber 40, and the second pressure chamber 42 comprise a binding structure.

A cup 60 workable as an engaging member is formed as tubular shape having a bottom by pressing a thin rolled steal plate having of a thickness of about 0.2–0.3 mm. The cup 60 has a circular bottom 62 engaged at one side of the spring 34 and a cylinder 64, elongated at the direction of rotation axis from the bottom 62, covering one edge of the spring 34. The cup 60 may be covered with nickel in order to restrain friction for the inner wall of the front plate 14. Outside of the bottom 62 is pushed to the inside wall of the front plate 14 by the spring 34. Outer diameter of the cup 60 becomes smaller than inner diameter of the hole 31 of the stopper piston 30. Regardlees of reciprocated location of the piston 30, opening of the cup 60 keeps inserted into the hole 31 of the back side of the taper hole 32. When the stopper piston 30 gets out of the fitting ring 36, as shown in FIG. 4, the whole cup 60 is inserted into the hole 31.

Figure 5:
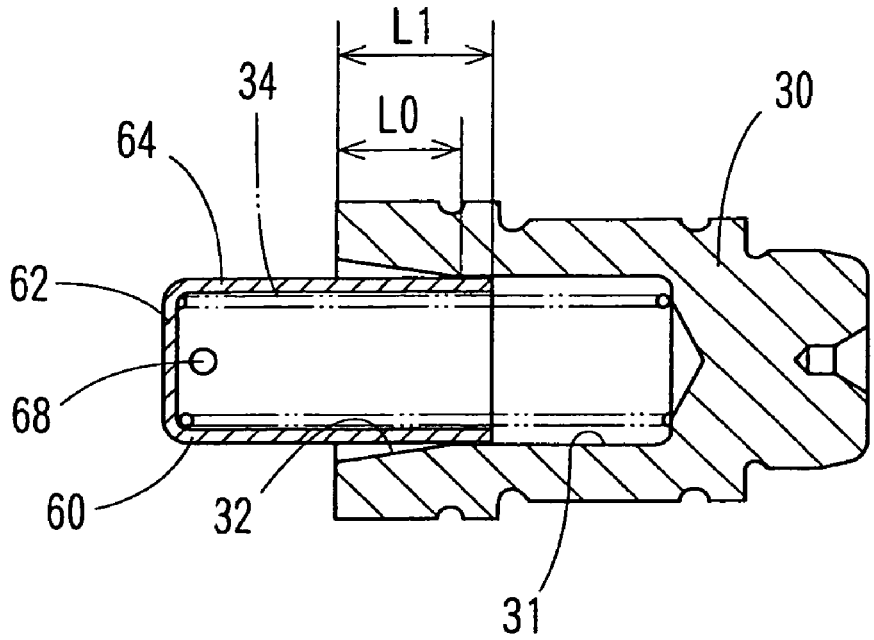
FIG. 5 is a schematic view showing natural length of a spring.

The cylinder 64 has four spill ports 68 at regular interval in the circumferential direction. The spill ports 68 communicate with the back-pressure chamber 38. As shown in FIG. 5, before the stopper piston 30, the spring 34 and the cup 60 are attached to the housing 11 and the vane rotor 16, the spring 34 is housed in the hole 31 with natural length and the opening of the cup 60 is inserted into the hole 31. Length L1, in which the cup 60 is inserted into hole 31, is longer than length L0 of the taper hole 32. In this manner, the cup 60 is inserted into the hole 31 of the back side of the taper hole 32 before the stopper piston 30, the spring 34 and the cup 60 are attached to the housing 11 and the vane rotor 16, so that the cup 60 can be prevented from colliding with the hole 31 even if the cup 30 is plunged in the hole 31 and the spring 34 contracts when attached.

As shown in FIG. 2, a retard oil pressure chamber 51 is formed between the shoe 13*a* and the vane 16*a*. A retard oil pressure chamber 52 is formed between the shoe 13*b* and the vane 16*b*. A retard oil pressure chamber 53 is formed between the shoe 13*c* and the vane 16*c*. A retard oil pressure chamber 54 is formed between the shoe 13*d* and the vane 16*d*. An advance oil pressure chamber 55 is formed between the shoe 13*d* and the vane 16*a*. An advance oil pressure chamber 56 is formed between the shoe 13*a* and the vane 16*b*. An advance oil pressure chamber 57 is formed between the shoe 13*b* and the vane 16*c*. An advance oil pressure chamber 58 is formed between the shoe 13*c* and the vane 16*d*.

In each retard oil pressure chamber, working oil is supplied from a retard oil passage 100 formed at the vane rotor 16 (shown in FIG. 1). In each advanced oil pressure chamber, the working oil is supplied from an advance oil passage 110 formed at the chain sprocket 12. The vane rotor 16 is relatively rotated for the housing 11 and phase difference of the camshaft for the crankshaft is adjusted by controlling supply or discharge of the working oil to or from both the retard oil passage 100 and the advance oil passage 110.

As described above, in the present embodiment, the stopper piston 30 is reciprocated in the penetrating hole 17 and one edge of the spring 34 urging the stopper piston 30 toward the fitting ring 36 is engaged at the inner bottom of the cup 60. The outer bottom of the cup 60 touches with the inner wall of the front plate 14. Pressure, which the inner wall of the front plate 14 receives, can decrease comparing with the structure, in which the spring 34 directly touches with the inner wall of the front plate 14, because touch area, in which outer bottom of the cup 60 touches with the inner wall of the front plate 14, is large. Further, when the vane rotor 16 is relatively rotated for the housing 11, wear of the inner wall of the front plate 14 can be reduced, comparing with the structure, in which the spring 34 directly touches with the inner wall of the front plate 14. Therefore, the working oil leakage between the retard oil pressure chamber 51 and the advance oil pressure chamber 55 can be restrained. Furthermore, the cup 60 comprises simple structure as tubular shape having the bottom, so that it can be easily produced by the press working and so on.

Reciprocating of the stopper piston 30 is not prevented by the cup 60 because the cup 60 is inserted into the hole 31 in the stopper piston 30, so that shaft length of the vane rotor 16 is not changed. Further, outer diameter of the cup 60 may be made small as far as the spring 34 can be housed, so that the cup 60 having the same outer diameter can be used even if the different size of the stopper piston 30 is used.

Load of the spring 34 does not change even if the same shaft length of the vane rotor 16, the stopper piston 30 and the spring 34 with structure, in which the spring 34 directly touches with the front plate 14, is used. Thus, additional components other than the cup 30 are not needed, so that the same components with structure, in which the spring 34 directly touches with the front plate 14, can be used.

Because of the spill port 68 formed at the cup 60, the working fluid is drained to the back-pressure chamber 38 through the spill port 68 when the stopper piston 30 gets out of the fitting ring 36. As a result, the inner space of the cup 60 can be prevented from operating as a damper, so that the stopper piston 30 can get out of the fitting ring 36 at once. The working fluid flows into the inner space of the cup 60 from the back-pressure chamber 38 through the spill port 68 when the stopper piston 30 is fitted into the fitting ring 36. As a result, the inner space of the cup 60 can be prevented from operating as a damper, so that the stopper piston 30 can be fitted into the fitting ring 36 at once.

The penetrated hole 17 penetrates the vane rotor 16 in the direction of the rotation axis thereof, so that the stopper piston 30 can be reciprocated in the penetrated hole 17. Centrifugal force by the rotation of the vane rotor 16 is prevented from arising in the reciprocating direction, so that reciprocation of the stopper piston 30 is not prevented.

MODIFICATION OF THE EMBODIMENT

The cup 60 may be gotten out of the hole 31 or the stopper piston 30 according to the position of the stopper piston 30.

Before the stopper piston 30, the spring 34 and the cup 60 are attached to the housing 11 and the vane rotor 16, the spring 34 may be out of the stopper piston 30 with natural length, and the cup 60 may be inserted into the hole 31 when attached.

As far as the cup 60 touches with the inner wall of the front plate 14 and one edge of the spring 34 may be covered with the cup 60, a side wall of the cup 60 is not only formed at continuous tubular shape in the circumferential direction, but also may be formed at pectinate shape elongated in the direction of the rotation axis.

Any number of the spill port 68 may be selected not to be restricted at four as far as the damper operation can be prevented. The spill port 68 may be formed around the opening side of the cup 60. The cup 60 may not have the spill port 68.

The housing 11 and the vane rotor 16 may be made of metal such as aluminum.

In above embodiment, although the valve timing controller controlling operation timing of the exhaust valve is described, the device may control only an intake valve or both the intake valve and the exhaust valve. In this case, the position, in which the stopper piston 30 is fitted into the fitting hole 37, may be the most retarded position or the most advanced position or between the most retarded position and the most advanced position.

The stopper piston 30 may be fitted into the fitting ring 36 by moving in the radial direction of the camshaft.

Rotation driving force of the crankshaft may be transferred to the camshaft by means of a timing pulley or a timing gear instead of the chain sprocket 12.

The driving force of the crankshaft may be received by the vane rotor 16, and the camshaft and the housing may be rotated all in one.

What is claimed is:

1. A valve timing controller arranged at a pathway transferring a driving force from a driving shaft to a driven shaft opening or closing at least one of an intake valve and an exhaust valve, the valve timing controller adjusting an opening or closing timing of at least one of the intake valve and the exhaust valve, the valve timing controller comprising:

a housing rotating with one of the driving shaft and the driven shaft, and having a fitting hole;

a rotor housed in the housing, rotating with the other of the driving shaft and the driven shaft, rotating in a direction of a retard and an advance relative to the housing by pressure of a working fluid, and having a penetrated hole;

a stopper reciprocating in a direction of the penetrated hole, binding the relative rotation of the rotor for the housing by being fitted into the fitting hole when the rotor is located at a predetermined position;

a urging member urging the stopper in the fitting direction; and an engaging member formed as a tubular shape having a bottom, an outer bottom of which is in contact with an inner wall of the housing existing in the opposite direction of the fitting direction, the engaging member engaging one side of the urging member and covering one edge of the urging member.

2. The valve timing controller according to claim 1, wherein the stopper has a hole, inner diameter of which is larger than outer diameter of the engaging member, wherein opening side of the engaging member keeps inserted into the hole regardless of location of the stopper.

3. The valve timing controller according to claim 2, wherein the engaging member has at least one spill hole in a side wall.

4. The valve timing controller according to claim 2, wherein before the stopper, the urging member and the engaging member are attached to the housing and the rotor, while one side of the urging member is engaged with the engaging member and the urging member is housed in the hole with natural length, the opening side of the engaging member keeps inserted into the hole.

5. The valve timing controller according to claim 1, wherein the penetrated hole penetrates the rotor in a rotative direction thereof.

6. The valve timing controller according to claim 1, wherein the housing has a plurality of spaces formed in the rotation direction, and the rotor has vanes, which are housed into the spaces, and relatively is rotated in the retard and advance direction by pressure of the working fluid in each retard oil pressure chamber and each advance oil pressure chamber in the each space, which is closed off by the vane.

* * * * *